US007288177B2

(12) United States Patent
Barrese et al.

(10) Patent No.: US 7,288,177 B2
(45) Date of Patent: Oct. 30, 2007

(54) SELECTIVE SHIELD/MATERIAL FLOW MECHANISM

(75) Inventors: Ralph A. Barrese, Binghamton, NY (US); Gary Gajdorus, Binghamton, NY (US); Allen H. Hopkins, Barton, NY (US); John J. Konrad, Endicott, NY (US); Robert C. Schaffer, Newark Valley, NY (US); Timothy L. Wells, Apalachin, NY (US)

(73) Assignee: International Business Machines Corporation, Armonk, NY (US)

( * ) Notice: Subject to any disclaimer, the term of this patent is extended or adjusted under 35 U.S.C. 154(b) by 592 days.

(21) Appl. No.: 10/813,351

(22) Filed: Mar. 30, 2004

(65) Prior Publication Data

US 2005/0218002 A1 Oct. 6, 2005

Related U.S. Application Data

(62) Division of application No. 09/871,557, filed on May 31, 2001, now Pat. No. 6,746,578.

(51) Int. Cl.

| | |
|---|---|
| ***C25D 5/00*** | (2006.01) |
| ***C25D 5/08*** | (2006.01) |
| ***C25D 7/12*** | (2006.01) |
| ***C25D 17/00*** | (2006.01) |

(52) U.S. Cl. ..... 205/96; 205/133; 205/157; 204/224 R; 427/304; 427/437; 427/443.1

(58) Field of Classification Search ..... 205/96, 205/133, 157; 204/224 R; 457/304, 437, 457/443.1

See application file for complete search history.

(56) References Cited

U.S. PATENT DOCUMENTS

| | | | | |
|---|---|---|---|---|
| 4,304,641 | A | 12/1981 | Grandia et al. | |
| 5,281,325 | A | 1/1994 | Berg | |
| 5,776,327 | A | 7/1998 | Botts et al. | |
| 5,985,123 | A | 11/1999 | Koon | |
| 2003/0038035 | A1* | 2/2003 | Wilson et al. | 205/96 |

FOREIGN PATENT DOCUMENTS

| | | |
|---|---|---|
| JP | 1-147627 | 6/1989 |

* cited by examiner

*Primary Examiner*—Roy King
*Assistant Examiner*—Nicholas A. Smith
(74) *Attorney, Agent, or Firm*—Scully, Scott, Murphy & Presser, P.C.; William H. Steinberg, Esq.

(57) ABSTRACT

An apparatus and method for plating a workpiece. The apparatus comprises, generally, an anode, a cathode, and a selective anode shield/material flow assembly. In use, both the anode and the cathode are immersed in a solution, and the cathode is used to support the workpiece. During an electroplating process, the anode and the cathode generate an electric field emanating from the anode towards the cathode, to generate a corresponding current to deposit an electroplating material on the workpiece. The selective shield/material flow assembly is located between the anode and the cathode, and forms a multitude of adjustable openings. These opening have sizes that are adjustable during the electroplating process for selectively and controllably adjusting the amount of electric flux passing through the selective shield/material flow assembly and the distribution of the electroplating material on the workpiece. The selective shield/material flow assembly can also be used with an electroless plating system. At least one selective shield material flow mechanism is used in a selective shield material flow assembly.

5 Claims, 7 Drawing Sheets

SELECTIVE SHIELD/MATERIAL FLOW MECHANISM

This application is a divisional of U.S. application Ser. No. 09/871,557, filed May 31, 2001, now U.S. Pat. No. 6,746,578.

BACKGROUND OF THE INVENTION

This invention generally relates to electroplating and electroless plating apparatus and methods.

Electroplating is a common process for depositing a thin film of metal or alloy on a substrate such as, for example, a variety of electronic components and semiconductor chips. In a typical electroplating apparatus or system, the substrate is placed in a suitable electrolyte bath containing ions of a metal to be deposited. The substrate is connected to the negative terminal of a power supply to form a cathode, and a suitable anode is connected to the positive terminal of the power supply. Electrical current flows between the anode and cathode through the electrolyte and metal is deposited on the substrate by an electrochemical reaction.

In many electronic components, it is desirable to deposit the metal film with a uniform thickness across the substrate and with uniformity of composition. However, the electroplating process is relatively complex, and various naturally occurring forces may adversely affect the electroplating process. Most significantly, the electrical current or flux path between the anode and the cathode may spread or curve, making it difficult to achieve uniform electrodeposition.

SUMMARY OF THE INVENTION

An object of this invention is to provide an improved electroplating apparatus and method.

Another object of the present invention is to selectively and controllably adjust the amount of electric flux passing towards selected areas of a workpiece, during an electroplating process, in order to deposit a metal film or alloy with a uniform thickness across the workpiece. This apparatus could also be used to regulate solution flow in an electroless plating deposition bath which would in turn make the bath more capable of depositing in small through holes.

A further object of this invention is to use a unique anode shield/material flow apparatus that can be controllably adjusted on the fly, during an electroplating process, to selectively isolate areas of the workpiece.

Another object of this invention is provide an infinitely adjustable mechanism that can selectively isolate areas to be electroplated.

These and other objectives are attained with an apparatus and method for electroplating a workpiece. The apparatus comprises, generally, an anode, a cathode, and a selective shield/material flow assembly. In use, both the anode and the cathode are immersed in a solution, and the cathode is used to support the workpiece. During an electroplating process, the anode and the cathode generate an electric field emanating from the anode towards the cathode, to generate a corresponding current to deposit an electroplating material on the workpiece.

The selective shield/material flow assembly is located between the anode and the cathode, and forms a multitude of adjustable openings. These openings have sizes that are adjustable during the electroplating process for selectively and controllably adjusting the amount of electric flux passing through the selective shield/material flow assembly and the distribution of the electroplating material on the workpiece.

With a preferred embodiment of the invention, described in detail below, the selective shield/material flow assembly is used to selectively isolate an area of the workpiece from plating by use of an individual adjustable selective shield/material flow mechanism. The selective flow material flow assembly can comprise one or more selective shield material flow mechanisms. The selective shield material flow assembly can be adjusted selectively on one, two, or multi axes. In another embodiment, the shielding, in the case of electroless plating, also slows or increases solution flow to areas of the plating surface and thus lowers or increases plating thickness and rates. The shielding or baffling also slows/isolates solution flow to the plating surface and thus lowers or raises plating thickness/rates. This causes more plating uniformity in panel or pattern plating equipment.

Further benefits and advantages of the invention will become apparent from a consideration of the following detailed description, given with reference to the accompanying drawings, which specify and show preferred embodiments of the invention.

DETAILED DESCRIPTION OF THE PREFERRED EMBODIMENTS

Figure 1:
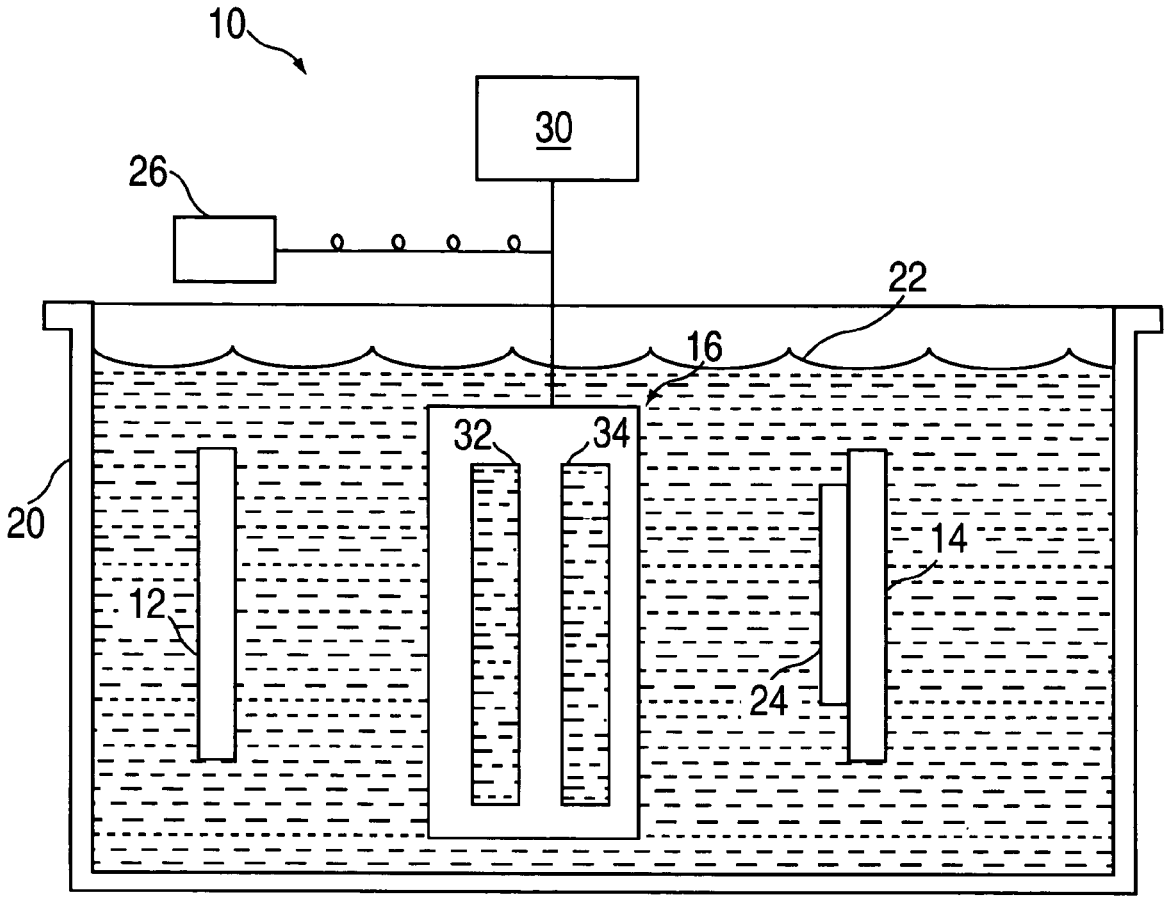
FIG. 1 diagrammatically illustrates a plating apparatus embodying the electrolytic plating version of this invention.
Figure 2:
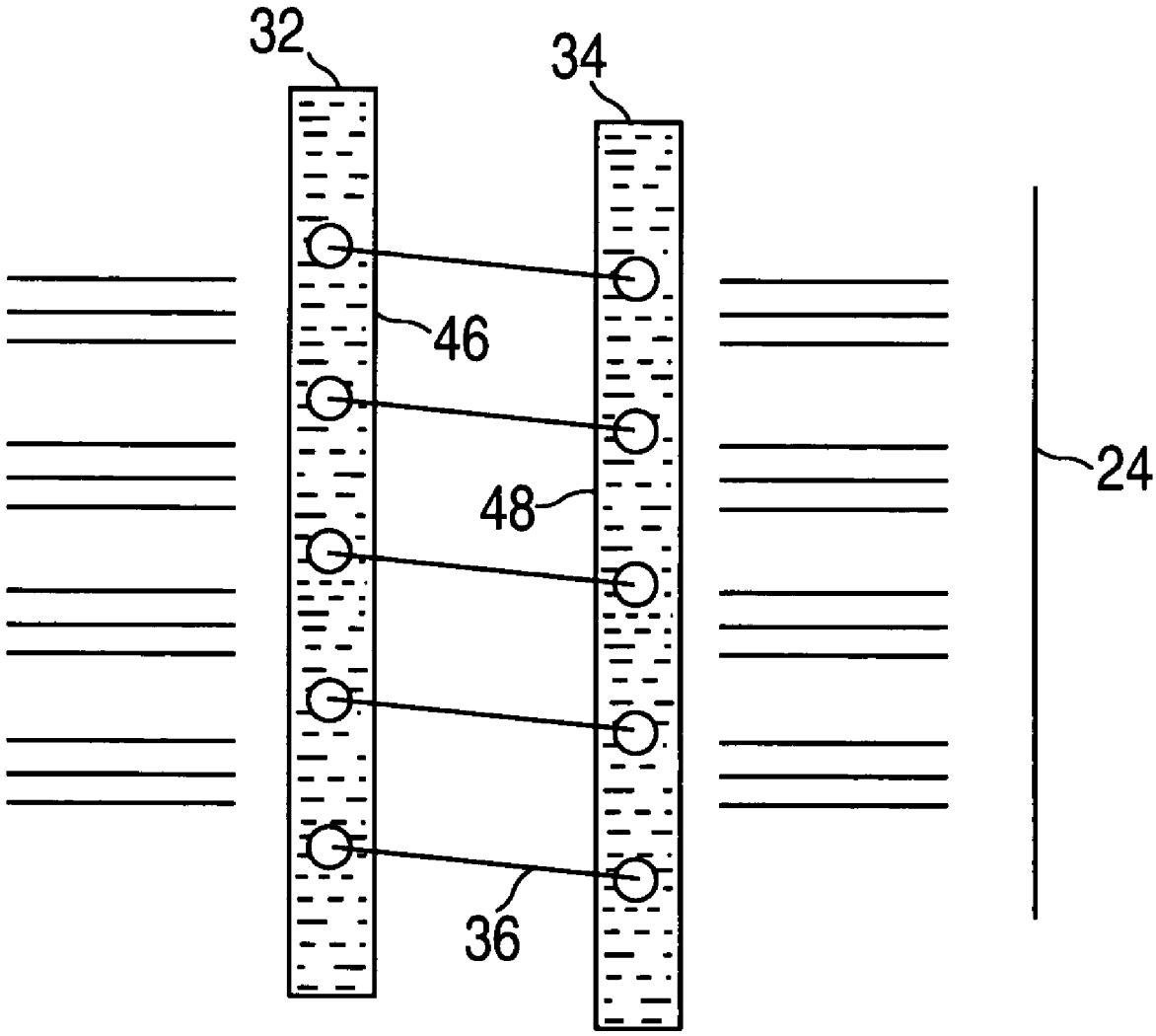
FIGS. 2 and 3 are diagrammatic side views of portions of the plating apparatus of FIG. 1, particularly showing the selective shield/material flow assembly of the apparatus.
Figure 3:
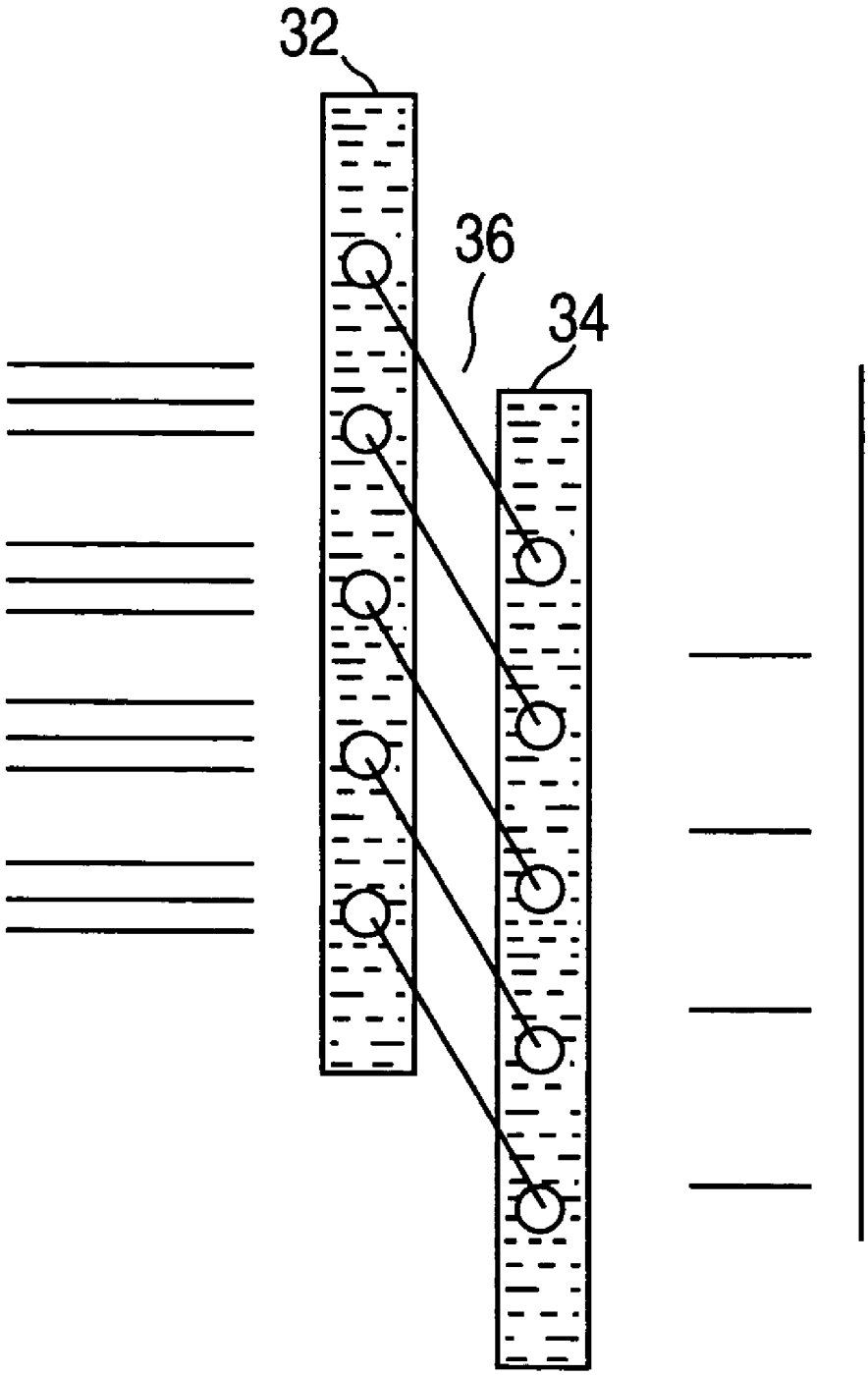
Figure 4:
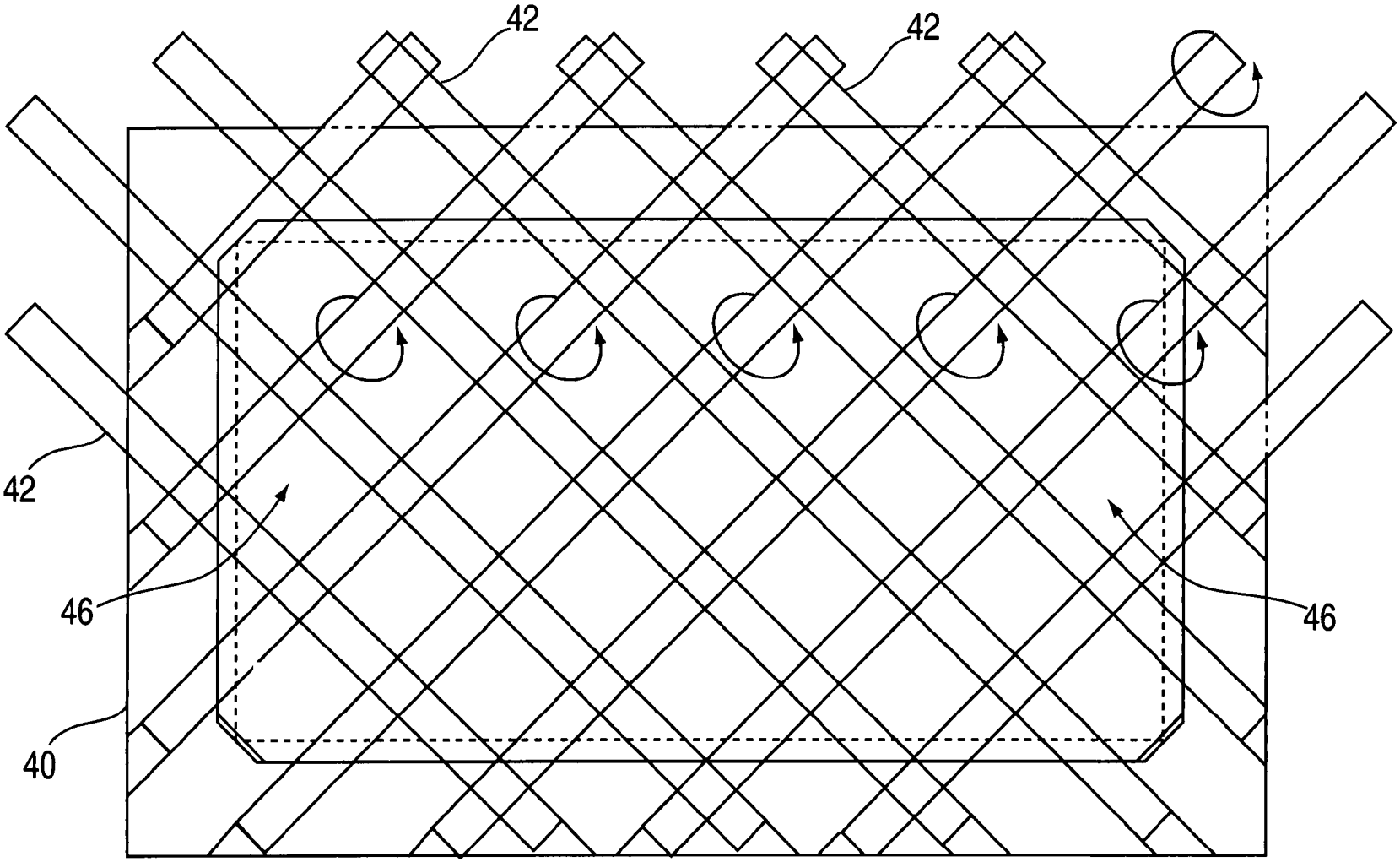
FIG. 4 is a front view of one of the selective shield/material flow assembly.
Figure 5:
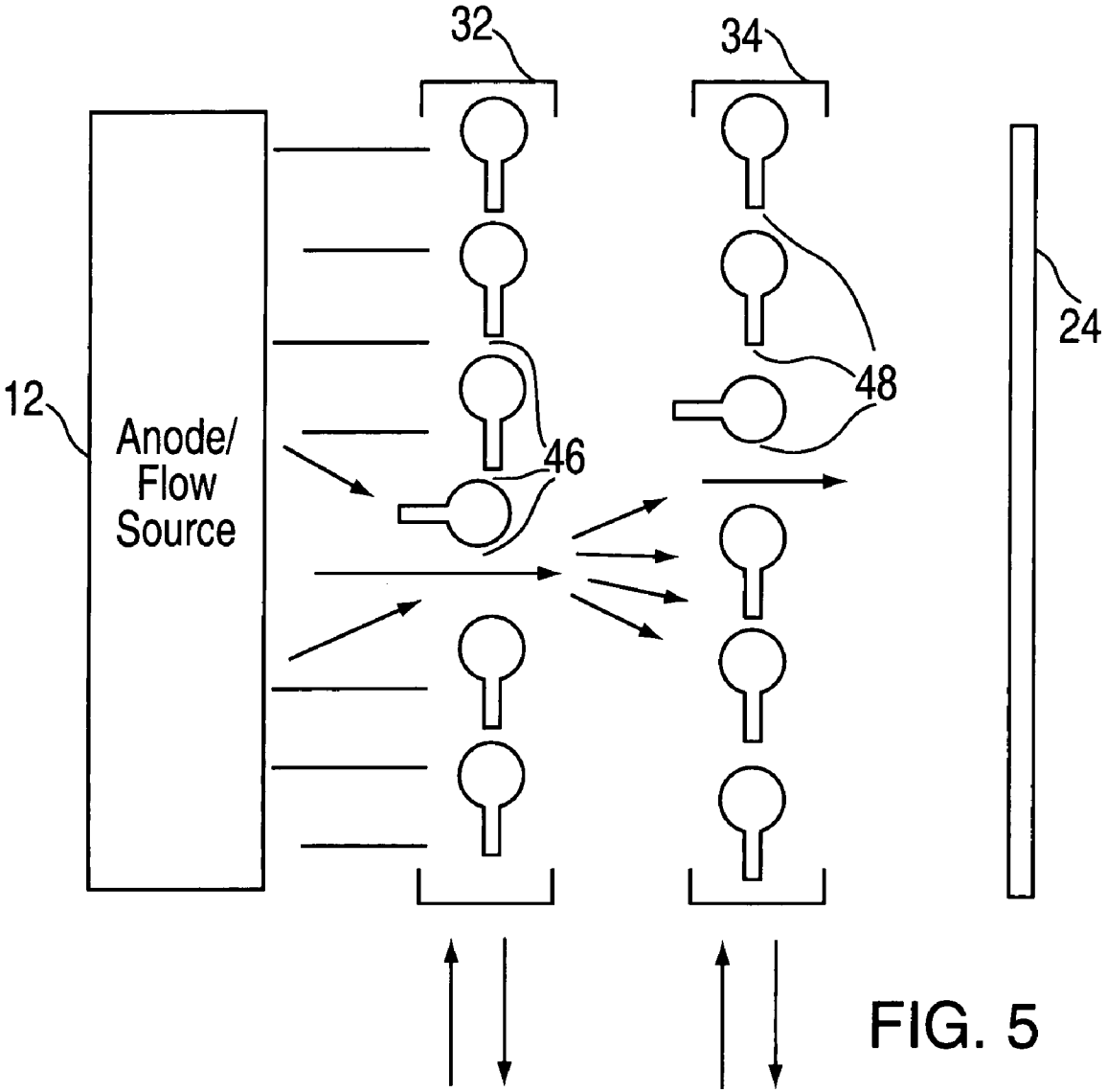
FIG. 5 is a top view cutaway of a selective shield/material flow assembly having two selective shield material flow mechanisms. The selective shield/material flow assembly is placed between a workpiece and a flow source of fresh plating solution such as a nozzle or sperger. All are immersed in the electroless plating solution bath.

FIG. 1 illustrates electroplating apparatus 10 generally comprising anode 12, cathode 14, and selective shield/material flow assembly 16. FIG. 1 also shows receptacle 20, electroplating solution 22, workpiece 24, selective shield/material flow assembly control 26, and selective shield/material flow assembly support 30. With reference to FIGS. 1-4, selective shield/material flow assembly 16 preferably comprises first and second individual selective shield/material flow mechanism 32 and 34, and connecting means 36 such as a series of connecting links. Each selective shield/material flow mechanism 32, 34, in turn, includes a support member or frame 40 and a series of slats 42 as shown in FIG. 4.

Returning to FIG. 1, receptacle 20 holds the electroplating solution 22, which contains the ions of the metal or alloy to be deposited on the workpiece 24. Any suitable receptacle and electroplating solution may be used in the practice of this invention. Preferably, the receptacle is formed of an electrically insulating and corrosion-resistant material such as plastic. Also, by way of example, solution 22 may be a copper sulfate solution, commonly referred to as "acid copper."

Anode 12 and cathode 14 are both immersed in solution 22, and workpiece 24 is mounted on the cathode. In use, the anode is connected to the positive side of a direct current source, and the cathode is connected to the negative side of the current source. An electric current flows from the anode to the cathode, via solution 22, and as a result, ions in solution are attracted to and become attached to workpiece 24.

In this process, the thickness of the film formed on the workpiece is a function of the current density, which in turn is a function of the current distribution between the anode and the cathode.

Selective shield/material flow assembly 16 is provided to adjust controllably the current density, during the electroplating process, in order to improve the uniformity of the thickness of the formed film. More specifically, selective shield/material flow assembly 16 forms a multitude of openings, and the sizes of these openings can be adjusted, during the electroplating process, for selectively and controllably adjusting the amount of electric flux passing through the selective shield/material flow assembly and, thus, the distribution of the electroplating material across the workpiece.

As mentioned above, the preferred embodiment of selective shield/material flow assembly 16 shown in the drawings comprises first and second individual selective shield/material flow mechanism 32 and 34, and connecting means 36 such as links. First selective shield/material flow mechanism 32 forms a first series of openings 46, second selective shield/material flow mechanism 34 forms a second series of openings 48, and those openings, in combination, form the adjustable openings 46 and 48, as shown in FIGS. 2, 3, 4 and 5, of selective shield/material flow assembly 16. Links 36 connect shield/material flow mechanisms 32 and 34 together for limited movement relative to each other; and, as illustrated by FIGS. 2 and 3, selective shield/material flow mechanisms 32 and 34 are moved relative to each other to change the sizes of through openings 46 and 48 of selective shield/material flow assembly 16.

Preferably, the individual selective shield/material flow mechanisms 32 and 34 are substantially identical, and thus only one will be described in detail. With particular reference to FIG. 4, which shows selective shield/material flow mechanism 32, this selective shield/material flow mechanism comprises frame or support member 40 and a series of slats 42. Slats 42 are supported by the support member 40 and extend thereacross, and the slats are positioned so as to form openings 46. As shown in FIG. 4, slats 42 slant across support member 40, although the slats may be positioned in other orientations.

While selective shield material flow (SSMF) assembly is shown with two selective shield material flow mechanisms, use of only one selective shield material flow mechanism is possible. Similarly, three or more SSMF mechanisms having 3 or more sets of slats set at various angles relative to each other to form specific shaped openings as needed.

Support member 40 and slats 42 may be made of any suitable non-conductive material or materials, and the slats may be supported by the support members in any suitable manner. For example, the slats may be adjustably or slidably mounted on the support member, or the slats may be detachably connected to the support member.

In FIG. 1 selective shield/material flow assembly control 26 is connected to selective shield/material flow assembly 16 for adjusting the sizes of openings 46 and 48 during the electroplating process. Preferably, this is done by moving selective shield/material flow mechanisms 32 and 34 relative to each other, and any suitable control may be used for this purpose.

Selective shield/material flow assembly support 30 is provided for supporting the selective shield/material flow assembly 16 for movement toward and away from at least one of the anode 12 and the cathode 14. Preferably, support 30 supports the selective shield/material flow assembly 16 for movement along three mutually orthogonal axes relative to both the anode and the cathode. As will be understood by those of ordinary skill in the art, any suitable support may be used in apparatus 10. In addition, the relative movement of the individual SSMF mechanisms can be a radial movement.

The present invention may be embodied in many different specific ways. For example, it may be noted that the present invention may be embodied in an apparatus in which the ions to be deposited on the workpiece come from the anode itself. In addition, in general, the apparatus can be used with electrolytic plating as well as electroless plating. It also has applications in areas other than plating such as air and fluid flow control, selective cooling and drying of a surface, selective etching, photo circuitization, heating, and material flow.

This invention may also be used with many types of workpieces. For instance, as describe above, the workpiece may be a printed circuit board or panel, or a semiconductor chip. The present invention may also be practiced with other types of workpieces, for example, to apply a decorative coating to a substrate or surface.

Figure 6:
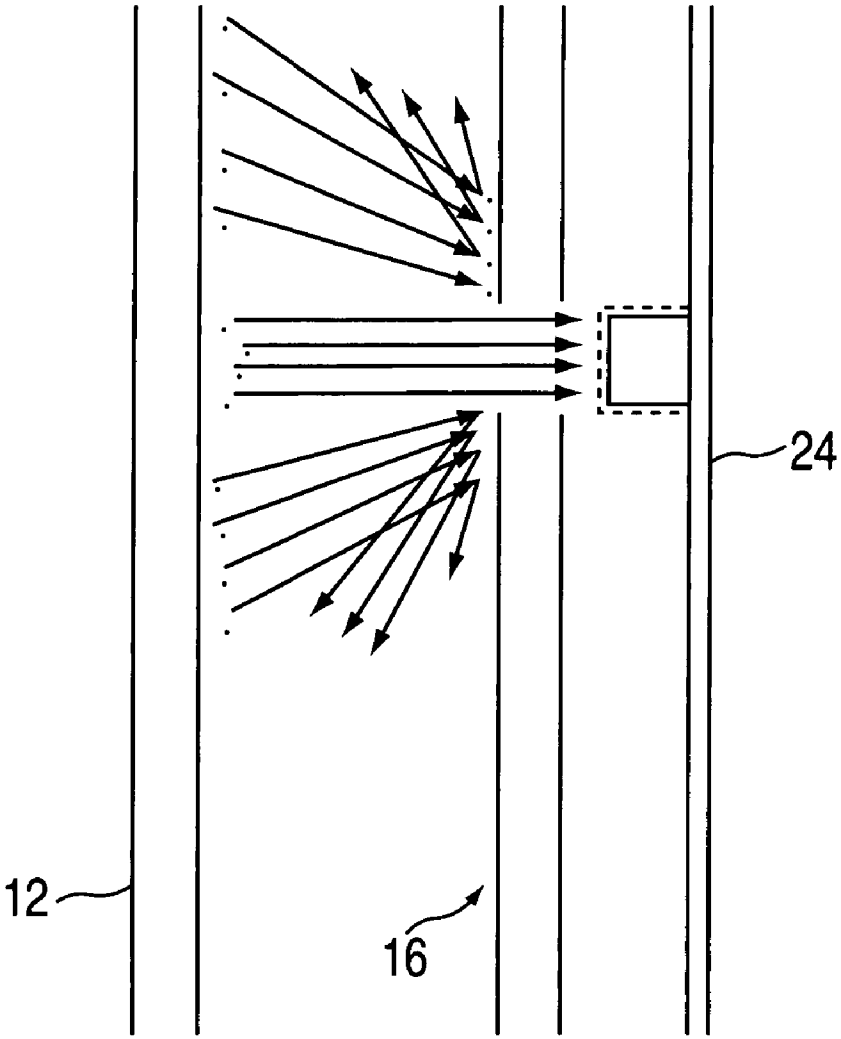
FIG. 6 illustrates an operation of this invention.

With the preferred embodiment of the invention, and with particular reference to FIG. 6, assembly 16 may be used to selectively isolate an area of a panel 24 from plating by use of individual adjustable selective shield/material flow mechanisms 32 and 34. The selective shield/material flow mechanism can be adjusted selectively on one, two or multi-axes. The shielding or baffling also slows/raises solution flow to-the plating surface and thus, lowers/raises plating thickness/rates. This causes more plating uniformity in panel or pattern plating equipment. This would be beneficial in surface mounting applications and chip carriers. This assembly 16 can be used in either static or dynamic plating machines. It may be used to reduce plating costs by reducing total average/mean thicknesses on a panel as in sacrificial thieving like panel borders or features to be eliminated later.

The assembly 16 also saves the most dollars in a precious metal plating system. This assembly may be used to control plating thicknesses from the source (anode), rather than from the destination (panel), as in thieving. The mechanism could be sequentially operated to give varying degrees of opening/baffling in a dynamic plating system. This benefits the first and last panel entering/exiting a plating cell. The selective shield material flow assembly can be set up to move with a part or the selective shield material flow assembly can be held stationary relative to the part. In either case the openings of the selective shield material flow mechanism can be adjusted dynamically. The assembly allows plating to be performed at higher currents due to better distribution, thereby increasing production rates.

Figure 7:
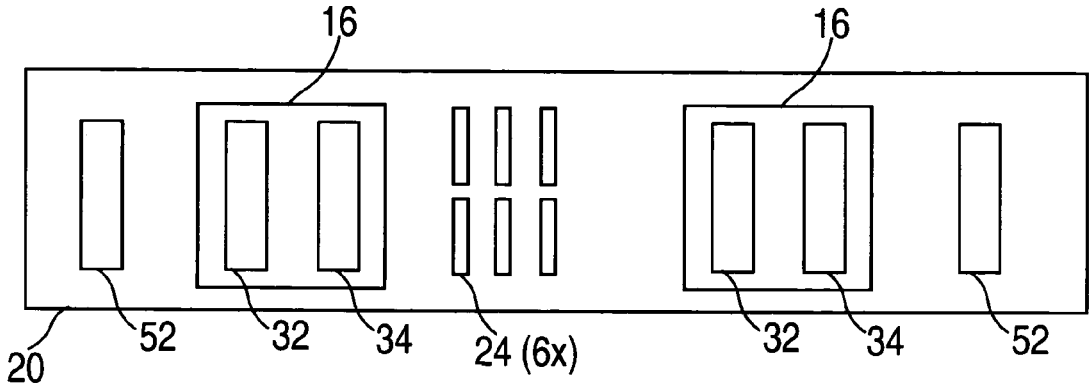
FIGS. 7 and 8 are top and side views, respectively, of an electroless plating apparatus; an electroless version of this invention.
Figure 8:
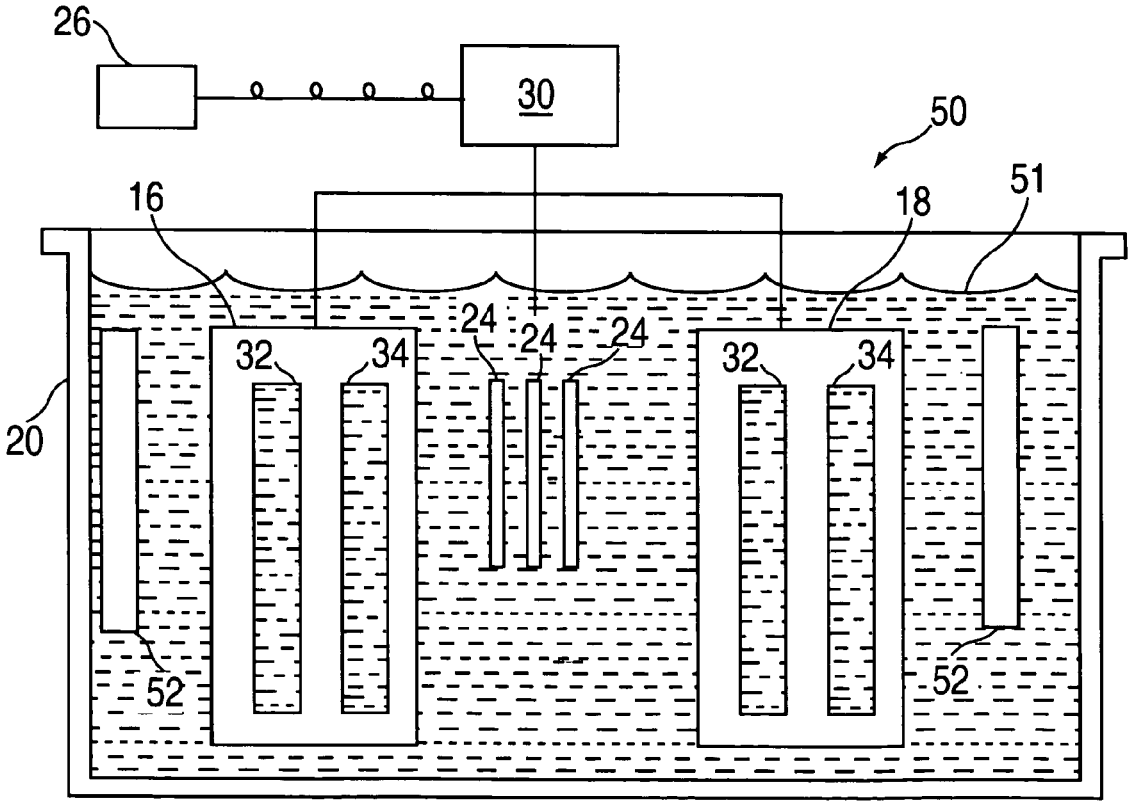

FIGS. 7 and 8 illustrate electroless apparatus 50 generally comprising solution agitation spargers 52, workpiece (24), and selective shield material flow assemblies 16. Assembly 16 preferably comprises first and second individual selective shield/material flow mechanisms 32 and 34. FIG. 8 also shows receptacle 20, electroless plating solution 51, workpiece(s) 24, selective shield material flow assembly control 26, and selective shield/material flow assembly supports 30. The selective shield material flow assembly essentially, in this case, selectively increases/decreases solution flow to the workpiece(s) which in turn increases/decreases plating thickness.

While the embodiments have shown methods and apparatus to perform selective electroplating or electroless plating, those skilled in the art will recognize that applications in areas other than plating are possible such as air flow control, drying and cooling, selective etching, photo circuitization and processing, heating control, e.g. infrared, and material flow e.g. spray coating, resist apply etc.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

The invention claimed is:

1. A method of electroplating a workpiece, comprising the steps:

immersing an anode and a cathode in a solution;

using the cathode to support the workpiece;

positioning a selective shield/material flow assembly between the anode and the cathode, said shield/material flow assembly forming a multitude of openings having adjustable sizes;

generating an electric field emanating from the anode to the cathode, to generate a corresponding current to deposit an electroplating material on the workpiece during an electroplating process;

adjusting the sizes of the adjustable openings, during the electroplating process, for selectively and controllably adjusting the amount of electric flux passing through the selective shield/material flow assembly and the distribution of the electroplating material across the workpiece;

wherein the selective shield/material flow assembly includes first and second selective shield/material flow mechanisms, and the adjusting step includes the step of moving the first and second selective shield/material flow mechanisms relative to each other to adjust the sizes of the opening of the selective shield/material flow assembly; and wherein the step of moving the first and second selective shield/material flow mechanisms also adjusts the location of the opening of the selective shield/material flow shield assembly.

2. A method of electroplating a workpiece, comprising the steps:

immersing an anode and a cathode in a solution;

using the cathode to support the workpiece;

positioning a selective shield/material flow assembly between the anode and the cathode, said shield/material flow assembly forming a multitude of openings having adjustable sizes;

generating an electric field emanating from the anode to the cathode, to generate a corresponding current to deposit an electroplating material on the workpiece during an electroplating process;

adjusting the sizes of the adjustable openings, during the electroplating process, for selectively and controllably adjusting the amount of electric flux passing through the selective shield/material flow assembly and the distribution of the electroplating material across the workpiece;

wherein the selective shield/material flow assembly includes first and second selective shield/material flow mechanisms, and the adjusting step includes the step of moving the first and second selective shield/material flow mechanisms relative to each other to adjust the sizes of the opening of the selective shield/material flow assembly; and wherein the first selective shield/material flow mechanism includes a first series of through openings, and the second selective shield/material flow mechanism includes a second series of through openings, and wherein;

the adjusting step further includes the step of using the first and second series of openings, in combination, to form the openings of the selective shield/material flow assembly; and the moving step includes the step of moving the first and second selective shield/material flow mechanisms laterally relative to each other to adjust the sizes of the openings of the selective shield/material flow assembly.

3. A method of electroplating a workpiece, comprising the steps:

immersing an anode and a cathode in a solution;

using the cathode to support the workpiece;

positioning a selective shield/material flow assembly between the anode and the cathode, said shield/material flow assembly forming a multitude of openings having adjustable sizes;

generating an electric field emanating from the anode to the cathode, to generate a corresponding current to deposit an electroplating material on the workpiece during an electroplating process;

adjusting the sizes of the adjustable openings, during the electroplating process, for selectively and controllably adjusting the amount of electric flux passing through the selective shield/material flow assembly and the distribution of the electroplating material across the workpiece;

wherein the selective shield/material flow assembly includes first and second selective shield/material flow mechanisms, and the adjusting step includes the step of moving the first and second selective shield/material flow mechanisms relative to each other to adjust the sizes of the opening of the selective shield/material flow assembly; and wherein the positioning step includes the step of connecting the first and second selective shield/material flow mechanisms together for limited movement relative to each other.

4. A method according to claim 3, wherein:

the positioning step includes the further step of providing a control means to move the selective shield/material flow mechanisms relative to each other; and the adjusting step includes the step of using the control means to move the selective shield/material flow mechanisms relative to each other during the electroplating/electroless process to adjust the sizes of the openings of the shield/material flow apparatus mechanism.

5. A method of plating a work piece comprising the steps of:

providing a source of depositing material;

providing a transport medium;

providing at least one work piece in a work piece holder;

supporting said at least one work piece in said work holder;

immersing said work piece holder in said transport medium;

positioning a selective shield/material flow assembly between said work piece holder and said source of depositing material in said transport medium, said selective shield/material flow assembly forming at least one opening having an adjustable size; and adjusting the said adjustable size of said at least one adjustable opening for selectively and controllably adjusting the amount of said depositing material passing through said selective shield/material flow apparatus and the distribution of said depositing material on said at least one work piece; and wherein said selective shield/material flow assembly further includes a first selective shield/material flow mechanism and a second selective shield/material flow mechanism, and the adjusting step includes the step of moving said first shield/material flow mechanism and said second shield/material flow mechanism relative to each other to adjust the said adjustable size of said at least one opening of said selective shield/material flow assembly.

* * * * *